US009226551B2

(12) United States Patent
Shikowitz et al.

(10) Patent No.: US 9,226,551 B2
(45) Date of Patent: Jan. 5, 2016

(54) LOCKING CLASP REQUIRING WEARER ASSISTANCE FOR REMOVAL

(71) Applicant: On Track Technologies Incorporated, Durham, NC (US)

(72) Inventors: Penny Shikowitz, Durham, NC (US); Glenwood Garner, III, Raleigh, NC (US); Richard W. Inskeep, Atlanta, GA (US)

(73) Assignee: On Track Technologies Incorporated, Durham, NC (US)

( * ) Notice: Subject to any disclaimer, the term of this patent is extended or adjusted under 35 U.S.C. 154(b) by 0 days.

(21) Appl. No.: 14/038,994

(22) Filed: Sep. 27, 2013

(65) Prior Publication Data

US 2014/0090213 A1 Apr. 3, 2014

Related U.S. Application Data

(60) Provisional application No. 61/707,103, filed on Sep. 28, 2012.

(51) Int. Cl.
*A44C 5/20* (2006.01)

(52) U.S. Cl.
CPC ..... *A44C 5/2085* (2013.01); *Y10T 24/45194* (2015.01)

(58) Field of Classification Search
CPC ..... A44C 5/2085; Y10T 24/45194; Y10T 24/4782; Y10T 24/2155
See application file for complete search history.

(56) References Cited

U.S. PATENT DOCUMENTS

| | | | | |
|---|---|---|---|---|
| 2,258,417 | A | | 10/1941 | Lund et al. |
| 2,508,147 | A | | 5/1950 | Dutch |
| 3,225,406 | A | | 12/1965 | Levy |
| 4,000,544 | A | | 1/1977 | Fildan |
| 4,158,951 | A | | 6/1979 | Cedar |
| 4,170,809 | A | | 10/1979 | Geldwerth et al. |
| 4,426,854 | A | | 1/1984 | Geldwerth et al. |
| 4,569,106 | A | * | 2/1986 | Lovato ..... 24/615 |
| 5,088,159 | A | | 2/1992 | Lafleur |
| 5,203,058 | A | * | 4/1993 | Krauss ..... 24/587.12 |
| 5,224,247 | A | * | 7/1993 | Collier ..... 24/587.12 |
| 5,231,740 | A | | 8/1993 | Mohebkhosravi |
| 5,261,257 | A | * | 11/1993 | Collier ..... 70/456 R |
| 5,272,795 | A | | 12/1993 | Rothstein |
| D352,678 | S | | 11/1994 | Fildan |
| 5,440,787 | A | * | 8/1995 | Figueroa et al. ..... 24/50 |
| 5,522,529 | A | | 6/1996 | Yurman et al. |
| 5,735,024 | A | * | 4/1998 | Ortiz ..... 24/573.11 |
| 6,031,460 | A | * | 2/2000 | Banks ..... 340/573.1 |
| 6,073,317 | A | * | 6/2000 | Barison ..... 24/115 F |

(Continued)

*Primary Examiner* — Robert J Sandy
*Assistant Examiner* — Louis Mercado
(74) *Attorney, Agent, or Firm* — Additon, Higgins & Pendleton, P.A.

(57) ABSTRACT

A securing device that requires wearer assistance for removal has a clasp that is unlocked by simultaneously disengaging movable ratchet teeth and sliding one half of the clasp past the other half. The clasp has a first portion and a second portion, each portion including a male connector having fixed ratchet teeth and a female connector having movable ratchet teeth. When the securing clasp is locked together by connecting the male connector of the first portion with the female connector of the second portion, and vice versa, it provides for the securement of an adjoining wristband. The securing device can be unlocked by anyone using a two-hand grip but not by a wearer of the device on their wrist, because the wearer only has the use of one hand to unlock the securing device.

12 Claims, 5 Drawing Sheets

(56) References Cited

U.S. PATENT DOCUMENTS

| | | | | |
|---|---|---|---|---|
| 6,220,637 | B1 | 4/2001 | Kierl | |
| 6,571,434 | B2 * | 6/2003 | Ortiz | 24/615 |
| 6,859,982 | B1 * | 3/2005 | Carrillo | 24/584.1 |
| D527,309 | S | 8/2006 | Grimm | |
| 7,367,092 | B1 * | 5/2008 | Dilday | 24/615 |
| 7,445,293 | B2 * | 11/2008 | Smith et al. | 297/484 |
| 7,618,260 | B2 * | 11/2009 | Daniel et al. | 439/37 |
| 7,721,907 | B2 | 5/2010 | Keung | |
| D621,742 | S | 8/2010 | Paik | |
| 8,141,731 | B2 | 3/2012 | Mazurkiewicz et al. | |
| 8,196,267 | B2 | 6/2012 | Nalley et al. | |

* cited by examiner

LOCKING CLASP REQUIRING WEARER ASSISTANCE FOR REMOVAL

CROSS-REFERENCE TO PRIORITY APPLICATION

This application hereby claims the benefit of U.S. Provisional Patent Application No. 61/707,103 for a "Locking Clasp Requiring Wearer Assistance for Removal" (filed Sep. 28, 2012, at the United States Patent and Trademark Office), which is hereby incorporated by reference in its entirety.

FIELD OF THE INVENTION

The present invention relates generally to clasp mechanisms that require wearer assistance for removal. More particularly, embodiments of the present invention relate to clasp mechanisms that require assistance, but not a key or other tool, for removal. The present clasp mechanisms may be used to secure location-tracking devices on persons suffering from Alzheimer's, dementia, or other cognitive disorders where removal of the device poses a risk to the personal safety of the wearer.

BACKGROUND

Millions of people suffer from Alzheimer's, dementia, or other cognitive disorders. The number of people suffering from cognitive disorders will increase in the coming years as a larger percentage of the population enters old age. Many people suffering from cognitive disorders wander or otherwise become lost due to their disorder. If a person suffering from Alzheimer's or other dementia becomes lost, they may suffer serious injury.

Various means have been developed to track or locate patients with dementia or other cognitive disorders when they wander or get lost. These include Global Positioning System ("GPS") location-tracking devices that a patient may wear along with a receiver device for the family or caregiver. If the person with Alzheimer's or other dementia becomes lost, the caregiver will be able to determine the location of the person by utilizing the receiver.

Due to the patient's cognitive disorder, the patient may try to remove or otherwise dispose of any location-tracking device that they carry or wear. For this reason, typical securing or clasping mechanisms such as those used for jewelry, wrist watches, or the like are not adequate for use in attaching a location-tracking device to a patient suffering from dementia. These types of securing or clasping devices are designed to be removed by the wearer without the need for additional assistance and are therefore inadequate for use with a location-tracking device designed to be worn by a person that is suffering from Alzheimer's or other dementia.

To prevent the patient suffering from Alzheimer's or other dementia from removing or otherwise disposing of a location-tracking device, many location-tracking devices for use with patients feature a means for locking the location device to the patient. In the case of a wrist or ankle wearable location-tracking device, the method of attachment may typically involve (i) the use of a disposable plastic band and clasp combination that must be cut off or (ii) a reusable clasping band that is secured by the use of a lock and key.

The use of a location-tracking device attached to a patient by a disposable plastic band and clasp combination, or the like, that must be cut off in order to be removed from the patient has several drawbacks. First, these securing mechanisms are not reusable. Second, the clasp and band combinations are typically made of thin plastic and are not comfortable. Third, the clasp and band are typically obtrusive, resulting in the patient being self-conscious about wearing the device.

The use of a location-tracking device that is attached to a patient by a reusable securing device that can only be removed by unlocking the latch or clasp with a key or removal tool also presents problems. The key to the clasping band can be lost, forgotten, or otherwise unavailable to emergency responders. The use of a key or removal tool to lock and unlock the clasp may also upset some patients.

Due to the limitations of traditional and previously developed means and methods for securing a location-tracking device to a patient, there exists a current need for more efficient and effective devices and methods for securing a location-tracking device to patients with dementia or other cognitive disorders.

SUMMARY

Accordingly, in one aspect, the present invention embraces a more efficient and effective securing device (e.g., for securing a location-tracking device onto a patient with dementia or other cognitive disorders). Embodiments of the present invention address the above-described problems and/or other problems by providing a locking clasp that is comfortable, unobtrusive, and that can be unlocked by anyone using a two-hand grip, but cannot be unlocked by only using one hand.

In an exemplary embodiment, the securing device typically includes a locking clasp with a symmetric design having two substantially identical portions. Each portion typically includes a clasp enclosure, a male T-slider, and a female T-channel. The two portions of the clasp are typically joined by inserting the male T-slider of a first portion into the female T-channel of a second portion, and vice versa. When the T-slider is inserted into the T-channel, fixed ratchet teeth on the T-slider engage movable ratchet teeth on a movable spring arm. The two portions of the clasp lock together (e.g., to secure an adjoining wristband). The clasp may be unlocked by (i) simultaneously and sufficiently displacing each movable spring arm in order to disengage each set of movable ratchet teeth with its corresponding fixed ratchet teeth and (ii) applying the shear force necessary to slide one half of the clasp past the other. A release button is typically attached to each movable spring arm and extends beyond the clasp enclosure through a button hole. The release buttons can be used to displace each movable spring arm. Once the release button is released after being displaced, the release button and its corresponding movable spring arm will return to their original position due to the spring force exerted by the spring arm.

The T-slider typically includes an end cap, which prevents dirt and debris from fouling the operation of the fixed ratchet teeth, the movable ratchet teeth, and the movable spring arm. The end cap also prevents users from disengaging the fixed ratchet teeth and the movable ratchet teeth by inserting objects into the latch. The clasp typically includes electrical contacts, which complete a circuit via wires when the clasp is locked. The continuity of the circuit may be monitored by the microprocessor to determine if the securing device is locked or unlocked.

In one embodiment, the securing device may include a location-tracking device (e.g., a location-tracking device secured to an adjoining wristband). Accordingly, in a related aspect, the present invention embraces a securing device that is simple to use and requires no special skills or mechanical aptitude to attach and remove a location-tracking device from a patient.

The foregoing, as well as other objectives and advantages of the invention and the manner in which the same are accomplished, are further specified within the following detailed description and its accompanying figures.

DETAILED DESCRIPTION

In one aspect, the present invention embraces a securing device. In one embodiment, the securing device facilitates efficient and secure attachment of a location-tracking device (15) onto a patient with dementia or other cognitive disorders.

Figure 1A:
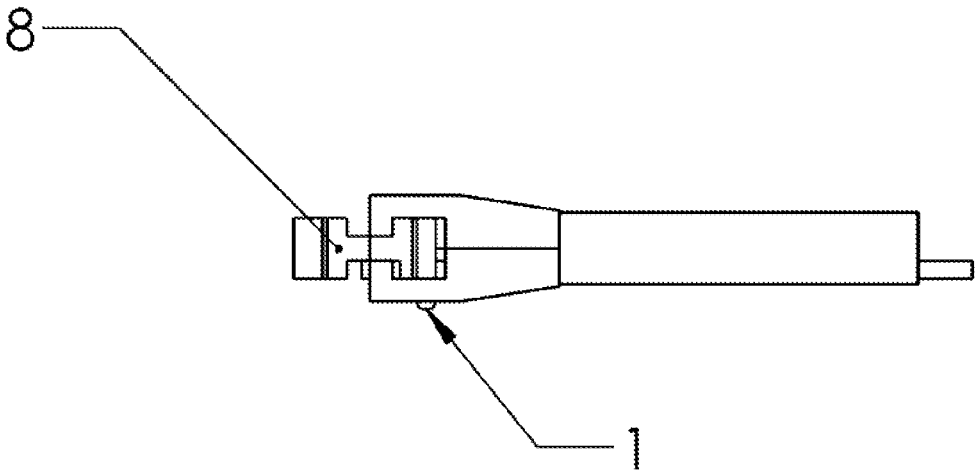
FIG. 1A is a side view of an exemplary securing device in an unlocked position.
Figure 1B:
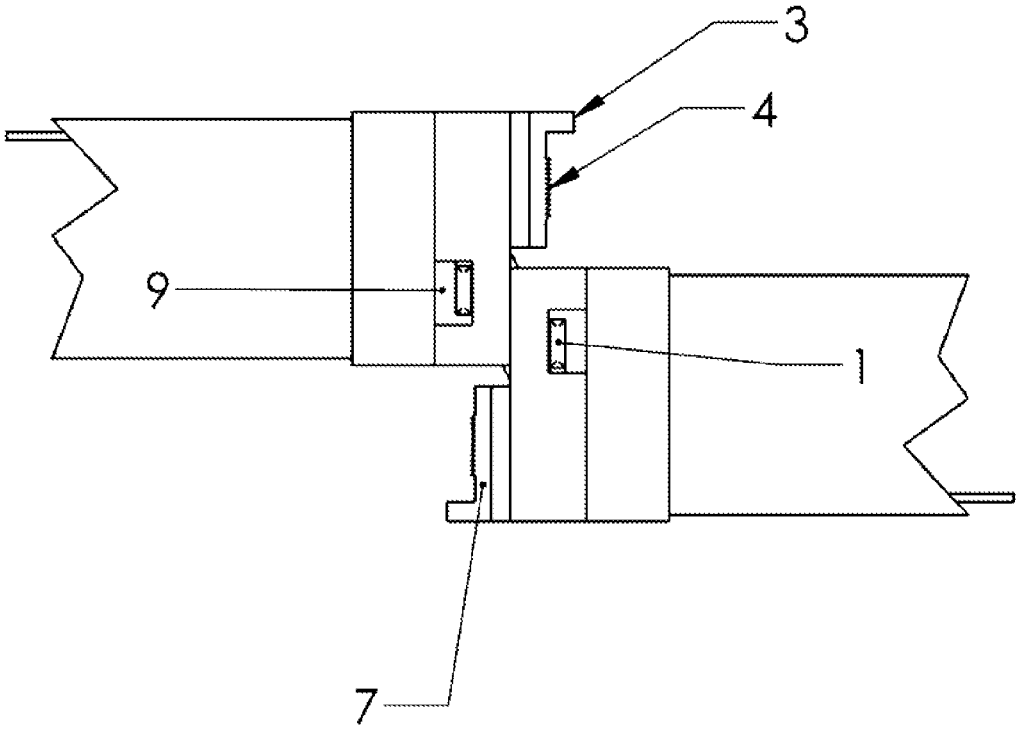
FIG. 1B is a top view of an exemplary securing device in an unlocked position.
Figure 2A:
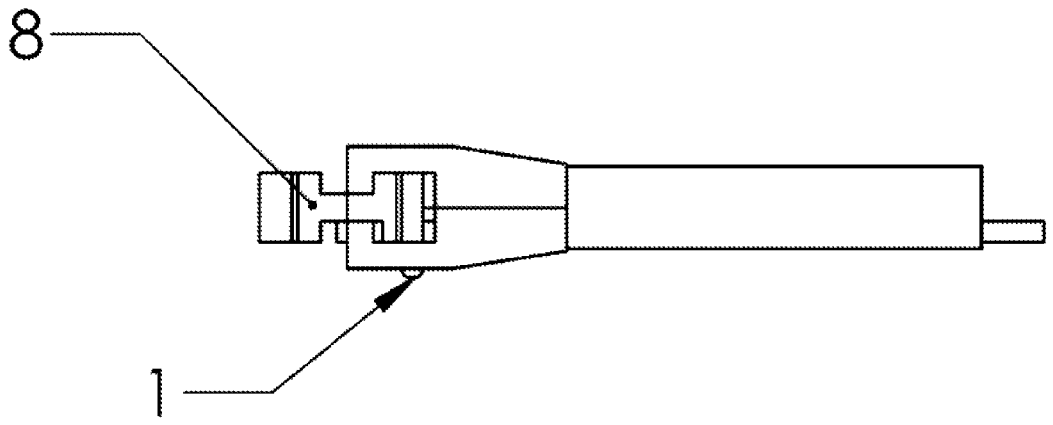
FIG. 2A is a cross-sectional internal side view of an exemplary securing device in an unlocked position.
Figure 2B:
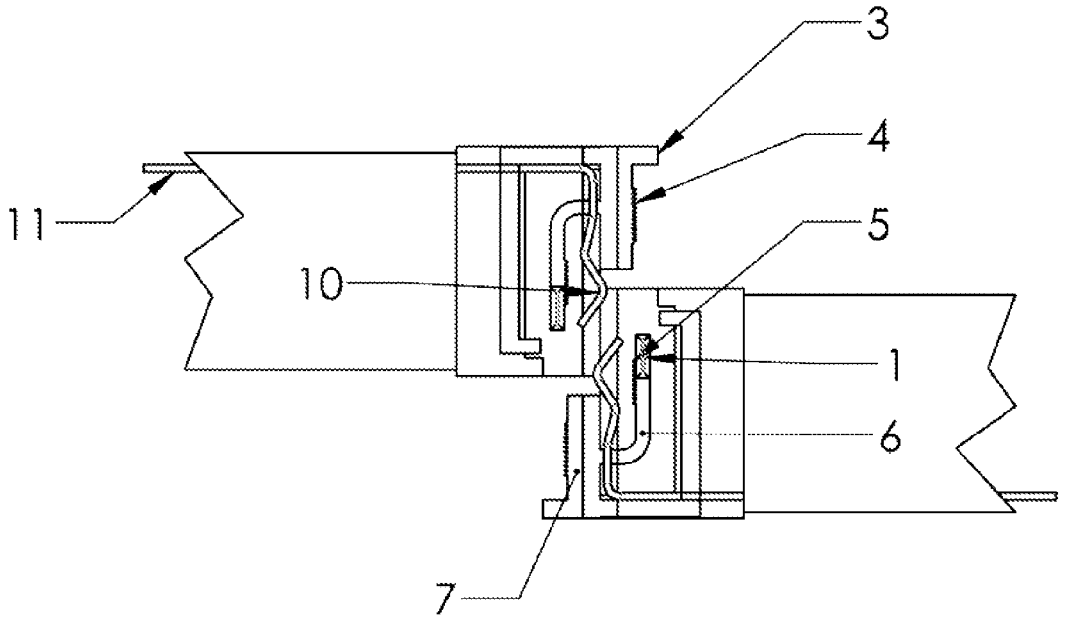
FIG. 2B is a cross-sectional internal a top view of an exemplary securing device in an unlocked position.
Figure 3A:
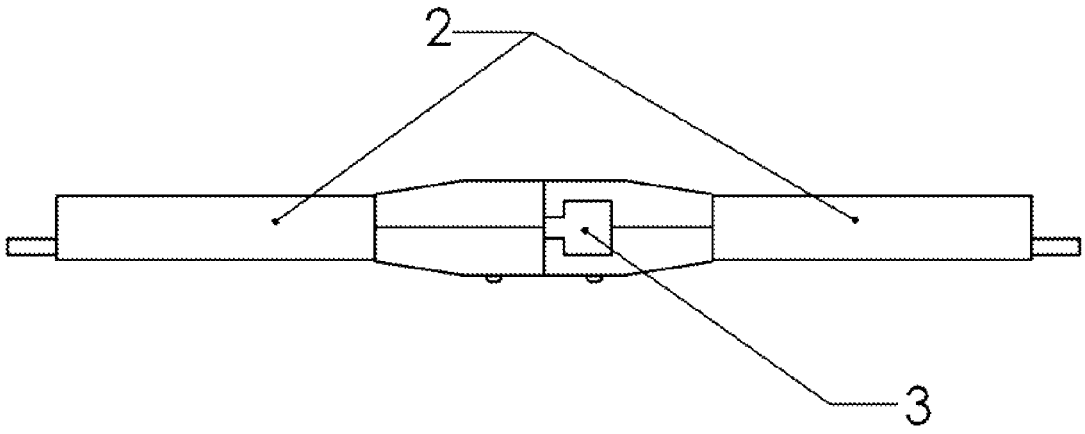
FIG. 3A is a side view of an exemplary securing device in a locked position.
Figure 3B:
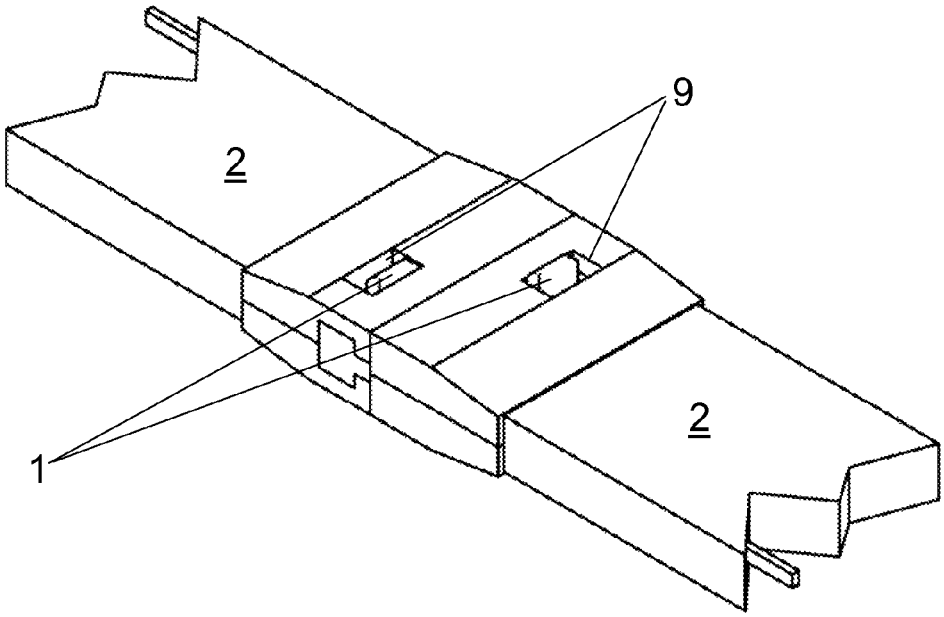
FIG. 3B is a top view of an exemplary securing device in a locked position.
Figure 4:
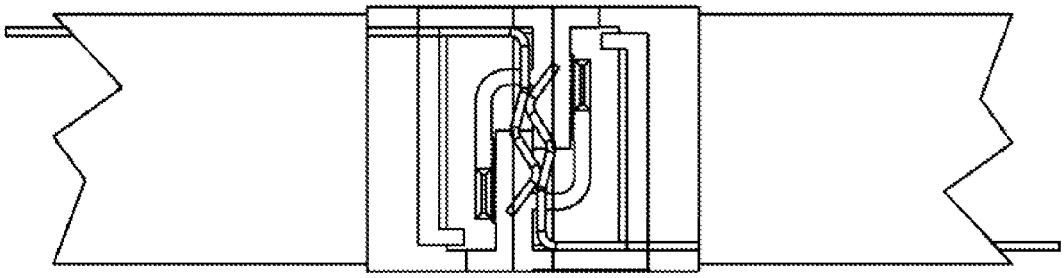
FIG. 4 is a cross-sectional internal top view of the securing device of FIG. 3A in a locked position.
Figure 5:
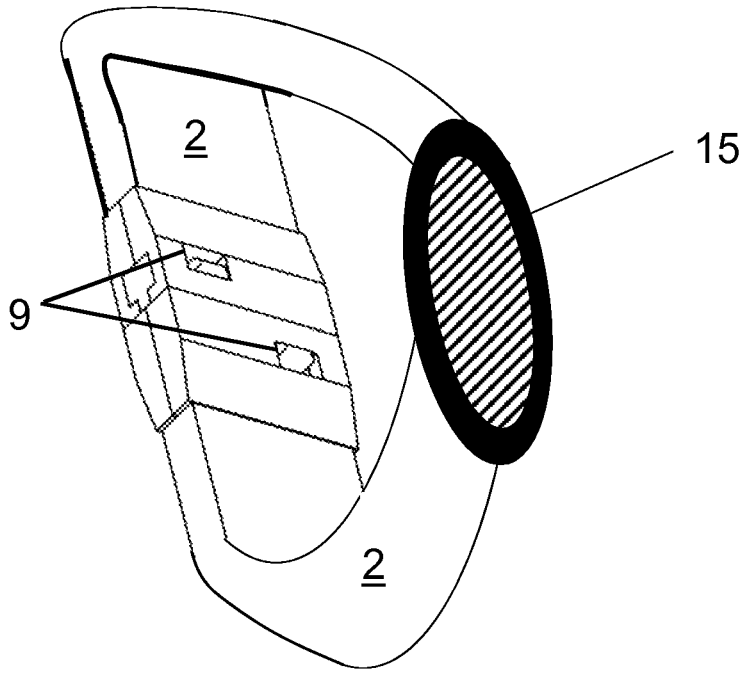
FIG. 5 is a perspective view of an exemplary securing device in a locked position and attached to a band with a location tracking device thereon.

As depicted in FIGS. 1-5, an exemplary securing device includes a securing clasp that joins together two portions of a band 2, more typically a wristband (e.g., a standard wristband or a decorative bracelet). The securing clasp typically includes a first portion and a second portion. As depicted in FIGS. 1-3, the securing clasp typically incorporates a symmetric design whereby the first and second portions of the securing clasp are identical to or a mirror image of each other.

Each portion of the securing clasp typically includes a clasp enclosure, a male T-slider 7, and a female T-channel 8. In the exemplary embodiment depicted in FIGS. 1-5, the two portions of the securing clasp are joined by (i) inserting the male T-slider 7 of the first portion into the female T-channel 8 of the second portion and (ii) inserting the male T-slider 7 of the second portion into the female T-channel 8 of the first portion. When the T-slider 7 is inserted into the T-channel 8, fixed ratchet teeth 4 on the T-slider 7 engage movable ratchet teeth 5 that are mounted on a movable spring arm 6 within the T-channel 8. Once each T-slider 7 has been inserted into its corresponding T-channel 8, the two portions of the securing clasp are locked together and provide securement of the adjoining band 2.

The securing clasp is capable of being unlocked by simultaneously disengaging the movable ratchet teeth 5 and applying the shear force necessary to slide one half of the clasp past the other. Typically, a release button 1 is attached to the movable spring arm 6 and extends beyond the clasp enclosure through the button hole 9. When pressed, the release button 1 is displaced (e.g., laterally displaced), thereby displacing the movable spring arm 6. As depicted in FIG. 3, the button hole 9 is typically larger than the release button 1 in order to allow sufficient lateral displacement of the release button 1. Once the movable spring arm 6 has been sufficiently displaced, the movable ratchet teeth 5 will disengage the fixed ratchet teeth 4. Once the release button 1 has been released, the movable spring arm 6 will return to its original position (e.g., due to its internal spring force).

The T-slider 7 portion of the exemplary securing clasp typically includes an end cap 3, which prevents dirt and debris from fouling the operation of the fixed ratchet teeth 4, the movable ratchet teeth 5, and the movable spring arm 6. The end cap 3 also prevents wearers (e.g., patients) from disengaging the fixed ratchet teeth 4 and the movable ratchet teeth 5 by inserting objects into the clasp. The securing device also typically includes electrical contacts 10, which complete a circuit via wires 11 when the clasp is closed. The continuity of the circuit may be monitored by a receiver or the like in order to determine if the clasp is locked or unlocked.

The foregoing notwithstanding, the securing clasp need not embrace the symmetric design depicted in FIGS. 1-3. Rather, portions of the securing clasp ought to be capable of being joined by way of (i) ratchet teeth that are fixed and (ii) ratchet teeth that are movable. That said, the present securing clasp typically has two releasable ratchet mechanisms (e.g., the movable ratchet teeth 5 attached to the movable spring arm 6). Accordingly, the securing clasp can be unlocked by someone using a two-hand grip, but cannot be easily unlocked using one hand.

The present securing device may be utilized to attach a location-tracking device (e.g., a GPS) to a wearer (e.g., by attaching the location-tracking device to the wristband 2).

More particularly, the present securing device may be used to secure a location-tracking device onto a patient with dementia or other cognitive disorders. Because the present securing device cannot be easily unlocked using one hand, it cannot be easily removed by a patient wearing the securing device. Moreover, the present securing device provides a locking mechanism that is comfortable and unobtrusive. Therefore, the present securing device is a more efficient and effective device for securing a location-tracking device onto a patient with dementia or other cognitive disorders.

In the specification and/or figures, typical embodiments of the invention have been disclosed. The present invention is not limited to such exemplary embodiments. The use of the term "and/or" includes any and all combinations of one or more of the associated listed items. The figures are schematic representations and, as such, are not necessarily drawn to scale. Unless otherwise noted, specific terms have been used in a generic and descriptive sense and not for purposes of limitation.

The invention claimed is:

1. A securing device for use in caring for persons suffering from Alzheimer's, dementia, or other cognitive disorders, wherein the securing device may be used to securely attach a location-tracking device, the securing device comprising:

a securing clasp having a first connector portion and a second connector portion that are capable of being joined together; and a band attached to said first and second connector portions of said clasp;

wherein each of said first and second connector portions defines a male connector having fixed ratchet teeth and a female connector having movable ratchet teeth; and wherein each of said first and second connector portions comprises a release button attached to a movable spring arm;

wherein, when said securing clasp is in a locked position, (i) said first connector portion's fixed ratchet teeth engage said second connector portion's movable ratchet teeth, and (ii) said second connector portion's fixed ratchet teeth engage said first connector portion's movable ratchet teeth.

2. The securing device according to claim 1, wherein each of said first and second connector portions comprises said movable spring arm upon which said movable ratchet teeth are mounted.

3. The securing device according to claim 1 wherein, when said securing clasp is in the locked position, sufficiently displacing said release buttons (i) displaces said movable spring arms and (ii) disengages said fixed ratchet teeth and said movable ratchet teeth.

4. The securing device according to claim 1 wherein said securing clasp is configured so that, when said securing clasp is in the locked position, unlocking said securing clasp requires:

simultaneously and sufficiently displacing said first connector portion's release button and said second connector portion's release button in order to disengage (i) said first connector portion's fixed ratchet teeth and said second connector portion's movable ratchet teeth and (ii) said second connector portion's fixed ratchet teeth and said first connector portion's movable ratchet teeth; and while said first connector portion's release button and said second connector portion's release button are sufficiently displaced, applying a shear force necessary to slide said first connector portion and said second connector portion away from each other.

5. The securing device according to claim 1, wherein each of said first and second portions comprises an electrical contact, said electrical contacts completing a circuit when said securing clasp is in the locked position.

6. The securing device according to claim 1, wherein said securing clasp is configured so that said securing clasp is disconnected by disengaging and sliding said first connector portion and said second connector portion past each other.

7. The securing device according to claim 1, comprising a location-tracking device.

8. A securing clasp, comprising:

a first connector portion and a second connector portion that are capable of being connected;

wherein said first connector portion and said second connector portion each comprises (i) a connector enclosure, (ii) a female connector having movable ratchet teeth and positioned within said connector enclosure, and (iii) a male connector having fixed ratchet teeth;

wherein, when the securing clasp is in a locked position, (i) said first connector portion's fixed ratchet teeth engage said second connector portion's movable ratchet teeth, and (ii) said second connector portion's fixed ratchet teeth engage said first connector portion's movable ratchet teeth;

wherein each of said female connectors comprises a cavity and a movable spring arm upon which its movable ratchet teeth are mounted; and wherein each of said female connectors comprises a release button attached to its movable spring arm.

9. The securing clasp according to claim 8, wherein, when the securing clasp is in the locked position, (i) said first connector portion's male connector is positioned within said second connector portion's cavity and (ii) said second connector portion's male connector is positioned within said first connector portion's cavity.

10. The securing clasp according to claim 8, wherein, when the securing clasp is in the locked position, sufficiently displacing said release buttons (i) displaces said movable spring arms and (ii) disengages said fixed ratchet teeth and said movable ratchet teeth.

11. The securing clasp according to claim 8, wherein said securing clasp is configured so that, when said securing clasp is in the locked position, unlocking said securing clasp requires:

simultaneously and sufficiently displacing said first connector portion's release button and said second connector portion's release button in order to disengage (i) said first connector portion's fixed ratchet teeth and said second connector portion's movable ratchet teeth and (ii) said second connector portion's fixed ratchet teeth and said first connector portion's movable ratchet teeth; and while said first connector portion's release button and said second connector portion's release button are sufficiently displaced, applying a shear force necessary to slide said first connector portion and said second connector portion away from each other.

12. A method of unlocking a securing clasp, comprising:

providing the securing clasp in a locked position, the securing clasp comprising:

a first connector portion and a second connector portion that are capable of being connected;

wherein said first connector portion and said second connector portion each comprises (i) a connector enclosure, (ii) a female connector positioned within the connector enclosure, the female connector having a cavity, a movable spring arm, movable ratchet teeth mounted on the movable spring arm, and a release button attached to the movable spring arm, and (iii) a male connector having fixed ratchet teeth;

wherein, when the securing clasp is in the locked position, (i) the first connector portion's male connector is positioned within the second connector portion's cavity so that the first connector portion's fixed ratchet teeth engage the second connector portion's movable ratchet teeth, and (ii) the second connector portion's male connector is positioned within the first connector portion's cavity so that the second connector portion's fixed ratchet teeth engage the first connector portion's movable ratchet teeth;

simultaneously and sufficiently displacing the first connector portion's release button and the second connector portion's release button in order to disengage (i) the first connector portion's fixed ratchet teeth and said second connector portion's movable ratchet teeth and (ii) said second connector portion's fixed ratchet teeth and said first connector portion's movable ratchet teeth; and while the first connector portion's release button and the second connector portion's release button are sufficiently displaced, applying a shear force necessary to slide said first connector portion and said second connector portion away from each other.

* * * * *